US006164218A

United States Patent [19]

Donalson

[11] Patent Number: 6,164,218

[45] Date of Patent: Dec. 26, 2000

[54] SUPINE ACTIVITY TABLE

[76] Inventor: Sandra Donalson, 1341 Wales Draive, Ft. Myers, Fla. 33901

[21] Appl. No.: 08/883,727

[22] Filed: Jun. 27, 1997

[51] Int. Cl.[7] ..... A47B 9/00

[52] U.S. Cl. ..... 108/144.11; 108/157.1; 248/445

[58] Field of Search ..... 108/144.11, 147.11, 108/106, 157.1, 158.12; 248/445, 188.2, 423; 211/187

[56] References Cited

U.S. PATENT DOCUMENTS

| | | | |
|---|---|---|---|
| 1,584,826 | 5/1926 | Uhl | 248/423 X |
| 2,468,856 | 5/1949 | Alexander | 108/144.11 X |
| 3,664,629 | 5/1972 | Reed | 248/445 |
| 3,740,015 | 6/1973 | Adams | 248/445 |
| 4,718,630 | 1/1988 | Richard | 248/445 X |
| 5,112,021 | 5/1992 | Greene | 248/445 X |
| 5,598,786 | 2/1997 | Patterson | 248/188.2 X |

FOREIGN PATENT DOCUMENTS

| | | | |
|---|---|---|---|
| 1130968 | 2/1957 | France | 248/423 |
| 1478012 | 6/1977 | United Kingdom | 248/445 |

*Primary Examiner*—Milton Nelson, Jr.
*Assistant Examiner*—Hanh V. Tran

[57] ABSTRACT

A supine table comprises a rectangular base, a pair of L-shaped side panels and an inverted U-shaped transparent table top connected to the side panels; wherein the transparent table top is adjustable in height relative to the base.

5 Claims, 1 Drawing Sheet

SUPINE ACTIVITY TABLE

This invention relates to the young child who is supine and needs activities for that position. It is particularly concerned with visual stimulation of objects and pictures to be placed face down, on a table top, to be observed by a child who is supine underneath. Also, it is to be used for attaching objects which can be manipulated by a child's hands.

BACKGROUND OF THE INVENTION

The inventor works with infants and toddlers with handicaps. While trying to provide activities to stimulate motor skill development and visual stimulation she thought of the idea of providing a transparent table that would fit safely over the child who is in a supine position. There is a need for these children to develop cognitive skills through motor activities of reaching and manipulating with the hands. This is a difficult task when done to one side or the other on the surface the child is lying on. The visual stimulation is accomplished when pictures or books are laid on a transparent top or attached to the sides of the table. Also, painting can be done directly on the transparent surface or on paper attached to underside of table top. Various devices have been proposed to accommodate the supine adult such as Bedside Book Holder, U.S. Pat. No. 4,465,255. None of these provide for the versatility needed by the young child who spends much of his/her time on a floor mat.

SUMMARY OF THE INVENTION

It is the object of my invention to provide an activity table designed specifically for young handicapped children who remain in a supine position most of the time. It will provide opportunities for the child to explore, investigate, manipulate, and view objects from their most constantly maintained position. A transparent surface area will allow for painting, picture observation, and mixing of liquids without dripping, spilling, or falling because of a lip which runs along the four sides of the surface. Paper can be taped on the underside of surface for the child to use paints, markers, or crayons.

My invention also encourages the development of gross motor skills by allowing the child to reach up to manipulate different toys and objects attached to underside of table surface by suction cups, Velcro, or elastic. The constant reaching up or out to the side to retrieve objects helps tone the muscles of a weak child. A table base which a child lays on before upper part of table is slid into channels provides a secure hold to prevent tipping. A narrow mat or cloth can cover base to provide for comfort. Holes around surface edge are designed for hanging toys by elastic.

DESCRIPTION OF THE INVENTION AS ILLUSTRATED

Figure 1:
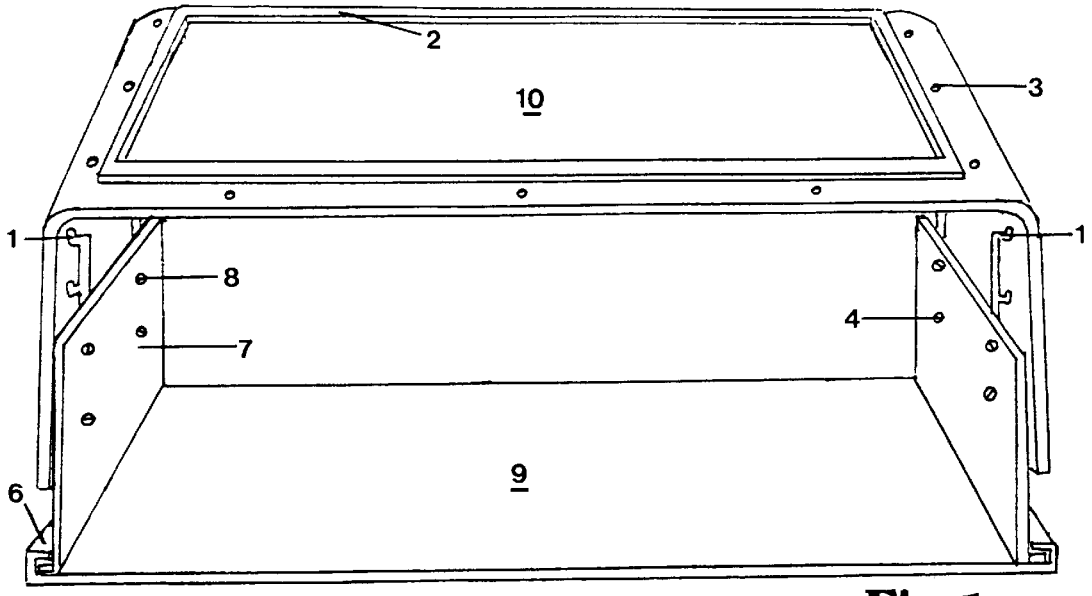
FIG. 1 is a perspective view of preferred embodiment.
Figure 3:
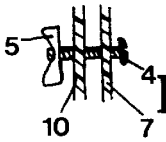
FIG. 3 is a close-up view of the wing nut of FIG. 2.
Figure 2:
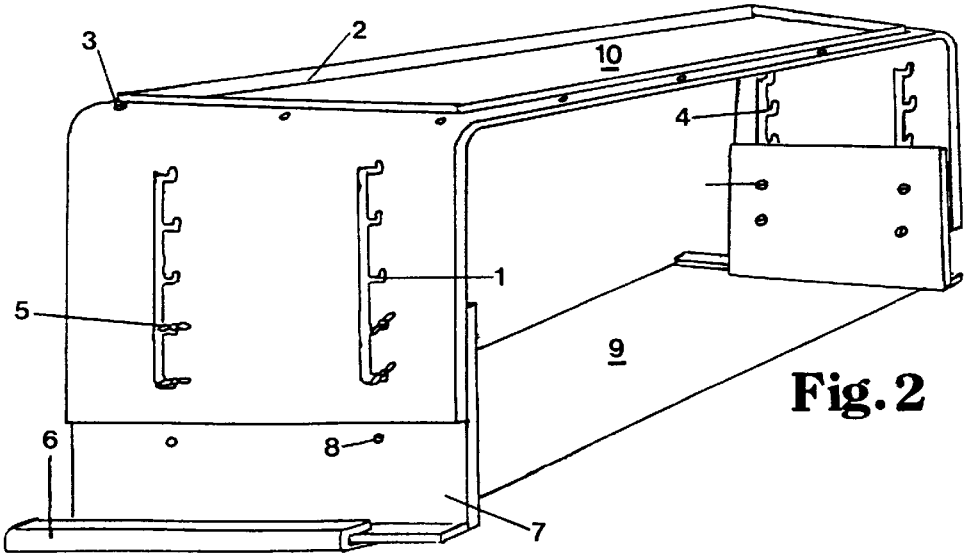
FIG. 2 is another perspective view of preferred embodiment of FIG. 1.

The supine table of the present invention comprises a rectangular base 9 and an upper portion composed of transparent material such as acrylic. The base 9 has two ends turned up to form guiding channels 6. The base 9 can be used on a bed or on the floor or a floor mat. Pictures can be placed on the underside of the base 9 for a child who is placed over it in a prone position.

The upper portion of the table comprises two L-shaped side panels and a U-shaped top. L-shaped panels 7 each has a horizontal section capable of sliding into the guiding channel 6 and a plurality of screw holes 8. The inverted U-shaped top comprises a horizontal surface and two vertical sections—each has two parallel vertical cut-out portions 1 for heightening and lowering horizontal surface at different elevations. Wing nuts 5 and screws 4 are provided for connecting the vertical sections to the L-shaped side panels 7 for security and stability.

A lip 2 on the horizontal surface 10 acts as a shield to prevent spills when liquids are used on the surface 10. These may include finger paints, oil, food coloring, or water. It may also prevent objects which slide easily from falling off the top surface including bowls, books, or laminated pictures.

Holes 3 are provided along the perimeter of the horizontal surface 10 edge for attaching toys to encourage grasping or manipulation. Short pieces of cord, elastic, or string can be run through the holes 3 and attached to a bead or button, which is larger than the hole 3, to secure it. The cord can also be used to secure manipulative toys which may be attached underneath the surface 10 of the table to encourage exploration of the toy to develop cognitive skills and reaching up to develop motor skills. Velcro straps may also be used to attach toys to the underneath side of the table surface 10.

The preferred embodiment of my invention has been described in the foregoing specification. This invention can also be understood as having been otherwise embodied in the following claims.

I claim:

1. A supine table comprises:

a rectangular base having two ends turned up to form guiding channels;

at least one L-shaped side panel having a horizontal section capable of sliding into one of said guiding channels, and a plurality of screw holes;

an inverted U-shaped top including: a horizontal surface and two vertical sections; wherein a plurality of holes are provided around the perimeter of the horizontal surface, a lip is provided on the horizontal surface to prevent object from falling off;

connecting means for connecting one of said vertical sections to said at least one side panel; and means for adjusting the height of the inverted U-shaped top at different elevations relative to the base.

2. A supine table as claimed in claim 1, wherein the connecting means comprises at least two wing nuts and at least two screws.

3. A supine table as claimed in claim 1, wherein said height adjusting means comprises two parallel vertical cut-out portions in each of the vertical sections of said inverted U-shaped top.

4. A supine table as claimed in claim 1, wherein said inverted U-shaped top is made out of a transparent material.

5. A supine table as claimed in claim 1, further comprises two L-shaped side panels.

* * * * *